US009175490B2

(12) United States Patent
Sato

(10) Patent No.: US 9,175,490 B2
(45) Date of Patent: Nov. 3, 2015

(54) SEISMIC ISOLATION APPARATUS AND STRUCTURE HAVING SEISMIC ISOLATION APPARATUS

(76) Inventor: Takanori Sato, Tokyo (JP)

( * ) Notice: Subject to any disclaimer, the term of this patent is extended or adjusted under 35 U.S.C. 154(b) by 348 days.

(21) Appl. No.: 13/167,028

(22) Filed: Jun. 23, 2011

(65) Prior Publication Data

US 2011/0289863 A1 Dec. 1, 2011

Related U.S. Application Data

(63) Continuation-in-part of application No. 12/247,333, filed on Oct. 8, 2008, now abandoned.

(30) Foreign Application Priority Data

Oct. 12, 2007 (JP) ..... 2007-266381

(51) Int. Cl.

| | |
|---|---|
| ***E04H 9/02*** | (2006.01) |
| ***E02D 27/34*** | (2006.01) |
| ***E04B 1/98*** | (2006.01) |

(52) U.S. Cl.

CPC ..... *E04H 9/021* (2013.01); *E02D 27/34* (2013.01); *E04B 1/98* (2013.01)

(58) Field of Classification Search

CPC ..... E04H 9/021; E04H 9/02; E02D 27/34; E02D 31/08; E04B 1/98

USPC ..... 52/167.1, 167.4, 167.5, 167.7, 167.9

See application file for complete search history.

(56) References Cited

U.S. PATENT DOCUMENTS

| | | | | |
|---|---|---|---|---|
| 951,028 | A | 3/1910 | Schar | |
| 2,002,934 | A | 5/1935 | Collins | |
| 4,320,549 | A * | 3/1982 | Greb | 14/73.5 |
| 4,517,778 | A | 5/1985 | Nicolai | |
| 4,881,350 | A | 11/1989 | Wu | |
| 5,261,200 | A | 11/1993 | Sasaki et al. | |
| 5,310,156 | A * | 5/1994 | Matsumura et al. | 248/615 |
| 5,438,807 | A * | 8/1995 | Shustov | 52/167.4 |
| 6,085,474 | A | 7/2000 | Mizuno | |
| 6,324,795 | B1 * | 12/2001 | Stiles et al. | 52/167.4 |
| 6,688,051 | B2 | 2/2004 | Tsai | |
| 6,725,612 | B2 | 4/2004 | Kim | |
| 6,862,849 | B2 | 3/2005 | Kim | |
| 6,948,284 | B2 | 9/2005 | Chiang | |
| 2002/0166296 | A1 | 11/2002 | Kim | |
| 2006/0174555 | A1 * | 8/2006 | Zayas et al. | 52/167.4 |
| 2007/0044395 | A1 * | 3/2007 | Lu et al. | 52/167.4 |

FOREIGN PATENT DOCUMENTS

| | | | |
|---|---|---|---|
| JP | 6-288066 | | 10/1994 |
| JP | 09317029 | A * | 12/1997 |
| JP | 2000-074138 | | 3/2000 |
| JP | 2002-039266 | | 2/2002 |
| JP | 2003-293614 | | 10/2003 |

* cited by examiner

*Primary Examiner* — Brian Glessner
*Assistant Examiner* — Jessie Fonseca
(74) *Attorney, Agent, or Firm* — Wenderoth, Lind & Ponack, L.L.P.

(57) ABSTRACT

To provide a seismic isolation apparatus which, as well as widening an applicable shaking range, can be easily configured and is low in height, a seismic isolation apparatus is configured of a low friction combination formed by a point contact between a planar hard base plate, which has a surface on which are disposed at least three convexly curved projections of a uniform height, and a glide plate which is a smooth, hard, flat plate.

22 Claims, 20 Drawing Sheets

SEISMIC ISOLATION APPARATUS AND STRUCTURE HAVING SEISMIC ISOLATION APPARATUS

This application is a continuation-in-part application of application Ser. No. 12/247,333, now abandoned, filed Oct. 8, 2008, which is hereby incorporated by reference in its entirety.

BACKGROUND OF THE INVENTION

1. Field of the Invention

The present invention relates to a seismic isolation apparatus, and to an item of equipment such as an automatic vending machine, or a structure like a building, which uses the seismic isolation apparatus.

2. Prior Art

In a seismic isolation apparatus, an ideal seismic isolation is a case in which a friction coefficient is zero. In this case, even in the event that a supporting surface shakes due to an earthquake, its body does not move at all. In the event that the friction coefficient is not zero, but exists even slightly, the body moves, and there is a possibility of a residual displacement occurring after the earthquake. However, in the event that it is possible to easily recover the residual displacement, there is no problem as an anti-earthquake measure. However, the friction coefficient being too low, so that the body moves easily at a time of regular use, is a problem. Designing is done to attain a friction coefficient that satisfies both. Generally, in order to reduce the friction coefficient, as well as using bearings or a material such as tetrafluoroethylene, there is a method whereby a contact surface pressure per unit area is increased. In order to do so, a measure whereby a contact surface is reduced being adopted, as examples adopting this kind of device to date, for example, ones in which there is a contact between planar members or curved members, which have a predetermined area, have been known (refer to JP-A-2000-74138 and JP-A-2002-39266).

Also, in the event of constructing a seismic isolated building using the heretofore described kind of seismic isolation apparatus, an example has been known in which, in order to build at a low cost, structures duplicatively disposed above and below the seismic isolation apparatus are simply constructed (refer to JP-A-2003-293614). In this case, a tabular foundation slab is constructed of ferroconcrete, below a building planar surface, as a foundation structure, and an upper surface thereof is made horizontal. A slip bearing, or the like, to be attached to the foundation slab is driven in to the same height as the upper surface of the concrete. A slip plate, or the like, to be attached to a concrete upper slab, is disposed on the upper surface of the foundation slab, a rubber air jack is disposed in an appropriate place, an arrangement of bars is carried out thereon, and concrete of the upper slab is cast. After the concrete hardens, air is injected into the air jack, the concrete upper slab is lifted up, the slip bearing main body, or the like, is disposed, the air is released from the air jack, and the concrete upper slab is lowered to a predetermined height.

However, with the heretofore described kind of previously known seismic isolation apparatus, not only is an overall height of the seismic isolation apparatus large, meaning that an effective utilization of space cannot be achieved, but also it is not possible to acquire a sufficiently low friction. Meanwhile, in the event of making a contact area small without limit, and forming a mechanical catch in a pointed form, the friction coefficient is raised too far instead. In attempting to avoid such a biting from occurring, surface hardness is also an important factor.

Also, with a building using the heretofore known seismic isolation apparatus, operations of inserting the air jack between the upper and lower slabs, and lifting the upper slab after the concrete hardens, are necessary operations that are troublesome, cause the construction schedule to lengthen, and cause the cost to soar. Furthermore, as the slip bearing main body is inserted under the concrete upper slab, it not being possible to insert it all the way on an interior side, a disposition of the slip bearing main body is restricted to a peripheral edge portion in a range reachable by hand. Thus, a problem to be solved lies in manufacturing, as a simple configuration and at a low cost, a seismic isolation apparatus with a low friction coefficient and a high surface hardness, and furthermore, using it in a seismic isolation structure, such as a small or medium scale building, by a simple method and at a low cost.

SUMMARY OF THE INVENTION

An object of the invention is to provide, as a simple configuration, a seismic isolation apparatus with a low friction coefficient and a high surface hardness, and to provide a seismic isolation structure in which such a seismic isolation apparatus can be used by a simple method and at a low cost.

In order to achieve the heretofore described objective, a seismic isolation apparatus according to the invention is configured in a low friction combination structure formed by a point contact between a planar hard base plate which has a surface on which are disposed at least three convexly curved projections of a uniform height, and a glide plate which is a smooth, hard, flat plate.

It is preferable that a contact surface of at least one of the hard base plate and the glide plate has a surface layer formed of any one of stainless steel, aluminum, a steel plate, tetrafluoroethylene, polyacetal, polyethylene, polypropylene, vinyl chloride, nylon, ABS, polycarbonate, acryl, polyurethane, polyimide, polyester, polyolefin, a hard rubber, carbon powder, molybdenum disulfide powder, or a powder coating, baking coating, cation electrodeposition coating, or fluororesin coating thereof.

It is preferable that a lubricating oil or a lubricating grease, which is a viscous medium or a viscoelastic medium, is applied between the hard base plate and the glide plate, which are in point contact. Also, it is acceptable that an elastic plate is affixed to one of an upper surface or a lower surface of the hard base plate and the glide plate in a superimposed condition.

It is also acceptable that the convexly curved projections have one more convex ring on a concentric circle on an exterior thereof. Furthermore, it is also acceptable that the convexly curved projections form intermittent slits along a circumferential direction of a concentric circle on the exterior thereof.

It is preferable that a radius of curvature r at an apex of the convexly curved projections is 30 mm or more. Also, it is also preferable that, as well as a whole of the hard base plate and the glide plate being formed as an approximately rectangular flat plate, corner portions of four corners thereof are in a diagonally cut (or chamfered) form.

A seismic isolation structure according to the invention is configured in such a way that the heretofore described seismic isolation apparatus is installed on one portion, or a whole, of a lower concrete foundation which has a planar upper surface, and an upper concrete foundation concrete of a building is formed on the seismic isolation apparatus, and taken as a foundation.

It is also acceptable that, in seismic isolation apparatus disposed in a peripheral portion of the building, among the seismic isolation apparatus installed on the lower concrete foundation, a waterproofing agent is loaded into a space between the hard base plate and the glide plate which configure the seismic isolation apparatus.

It is preferable that a coupling fixing unit is provided in a desired place on a side extremity of a peripheral portion of the upper and lower concrete foundation, or on a side extremity surface of an internal notch, and that a movement unit which returns the upper concrete foundation to an initial position is provided between coupling fixing units. Also, it is preferable that, in the movement unit, a sensor is inserted which can measure a lateral force required for a movement. Furthermore, it is also acceptable that the structure provides a slope onto which the seismic isolation apparatus runs in the event of moving beyond a predetermined movement distance.

Also, it is possible to adopt a seismic isolation structure wherein a seismic isolation floor is provided, formed leaving a movable range at one extremity side, using the heretofore described kind of seismic isolation apparatus, a non-seismic isolation floor is formed in contact with a wall on the side at which the movable range is left, and a portion toward a center of the non-seismic isolation floor and free end portion of the seismic isolation floor are slidably piled up with the seismic isolation apparatus provided therebetween. Furthermore, it is preferable that a damper is added, as a shock-absorbing material, to a side surface or a rear surface of the structure installed on the heretofore described kind of seismic isolation apparatus.

According to the seismic isolation apparatus of the invention, as a sliding between the approximately planar hard base plate, which has a large number of convexly curved projections of a uniform height, and the glide plate is utilized, an overall height (a thickness) of the seismic isolation apparatus is low (thin), and an effective utilization of space becomes possible. With the heretofore known seismic isolation apparatus, a movable displacement range at a time of an earthquake being limited, and there also being a limit to a size of an earthquake which can be responded to, the apparatus becomes large, and the cost increases considerably when attempting to enlarge the range, but as it is possible, with the invention, to easily widen the movable displacement range, it is possible to respond to an extremely low budget.

As a lubricating oil or a lubricating grease is applied between the hard base plate and the glide plate, which are in point contact, it is possible to further reduce the friction coefficient. Furthermore, because of the convexly curved projections of the invention, even in the event that dust encroaches, it does not adhere to a glide surface, the friction coefficient is maintained satisfactorily, and a long lifespan of the seismic isolation apparatus is achieved. By a lubricating oil or a lubricating grease, which is a viscous medium or a viscoelastic medium, being inserted or loaded between the hard base plate and the glide plate, a vibration energy at a time of an earthquake is absorbed, there is an anti-corrosion effect as water does not encroach even at a time of flooding, and a long-term durability is secured.

By affixing an elastic plate to one of the upper surface or the lower surface of the hard base plate, which has the convexly curved projections, and the glide plate in a superimposed condition, even in the event that there is some irregularity in a floor surface of concrete or the like, or in a lower surface of a seismic isolation subject, the elastic plate elastically deforms, absorbing an increase or decrease of the irregularity, when sliding forward or backward, left or right, in a horizontal direction at a time of an earthquake, and the apparatus can glide smoothly.

Also, by the convexly curved projections having one more convex ring on a concentric circle on the exterior thereof, or by forming intermittent slits along the circumferential direction of a concentric circle on the exterior thereof, as well as exercising the same kind of effect as the elastic plate, a number of parts is reduced, an internal stress of the projections is released by the slits at a time of a pressing process in the case of providing the slits, and it is possible to maintain a planar accuracy of a whole of the plate.

By making the radius of curvature r at the apex of the convexly curved projections 30 mm or more, the friction coefficient becomes 0.2 or less, which is appropriate for a seismic isolation. Also, by the whole of the hard base plate, which has the convexly curved projections, and the glide plate being an approximately rectangular flat plate, and the corner portions of the four corners thereof being diagonally cut (or chamfered), it is possible, utilizing the diagonally cut (or chamfered) portions at a time of a factory production, to temporarily bind the upper and lower plates together with an adhesive tape, reducing an encroachment of dust, and transport them. Also, after installing a large number of seismic isolation apparatus in predetermined positions, and joining the upper glide plates together with an adhesive tape, an operation of separating the upper and lower plates can be easily done by inserting a blade into a space between the cut portions, and severing the adhesive tape.

According to the seismic isolation structure of the invention, simply by closely laying the seismic isolation apparatus on the lower concrete foundation, and placing concrete thereon, a seismic isolation structure of a one-unit home is completed, it is extremely easy, and the work is done at a low cost without any complicated operation.

By integrating the glide plates of the seismic isolation apparatus, they become one portion of a formwork, and it is possible to cast concrete into it on site. Consequently, one portion of the seismic isolation apparatus doubling as one portion of the formwork for the concrete, a construction schedule is shortened.

By loading a waterproofing agent between the base and the glide plate of the seismic isolation apparatus disposed on the periphery, among the seismic isolation apparatus closely laid on the concrete foundation, there is protection from water encroaching inside the seismic isolation apparatus, causing corrosion, at a time of flooding due to rain.

Also, in a structure with the seismic isolation apparatus, by furnishing a movement unit such as a lever block or a chain block, it is possible, after the upper concrete foundation has moved due to an earthquake or the like, to return it to an original position with a simple structure, and at a low cost.

Furthermore, by providing a movement unit in which is inserted a sensor such as a load cell, which can measure a lateral force required for a movement, it is possible to regularly check a seismic isolation performance other than at a time of construction, and an increase in a reliability at a time of an earthquake occurring can be achieved.

In the seismic isolation structure, by providing a slope onto which the seismic isolation apparatus runs in the event of moving beyond a predetermined movement distance, as well as preventing an unforeseen movement of the building at a time of an earthquake, and preventing damage or the like, it is possible to assure safety.

Also, by providing a seismic isolation floor formed leaving a movable range at one extremity side, forming a non-seismic isolation floor in contact with the wall on the side at which the movable range is left, and forming the seismic isolation floor, using the seismic isolation apparatus, in a portion toward the center of the non-seismic isolation floor, it becomes possible to place furniture or the like on a periphery of a floor surface, and it is possible to effectively utilize an inside of a room.

Furthermore, in a case of applying the seismic isolation apparatus to a cash dispenser, an automatic vending machine, an item of furniture, another instrument, or the like, by adding a damper, as a shock-absorbing material, between the seismic isolation subject and a wall surface with which there is a danger of a side surface or a back surface of the seismic isolation subject colliding at a time of an earthquake, damage such as a breakage is prevented at a time of an earthquake by the shock-absorbing material.

BRIEF DESCRIPTION OF THE DRAWINGS

FIG. 12A is a longitudinal sectional view showing a seismic isolation apparatus according to a fifth embodiment, while

DETAILED DESCRIPTION OF THE PREFERRED EMBODIMENTS

Figure 1:
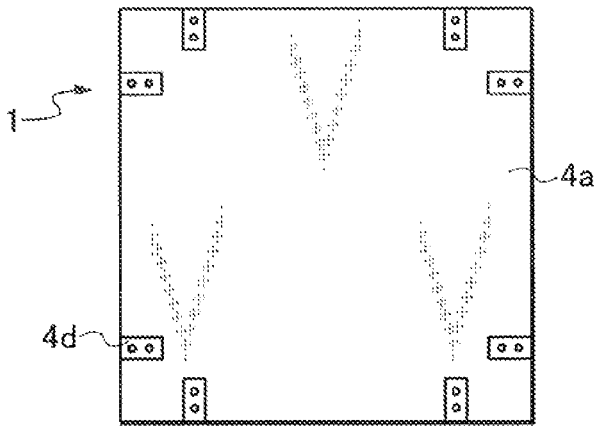
FIG. 1 is a plan view showing a seismic isolation apparatus according to a first embodiment of the invention.
Figure 2:
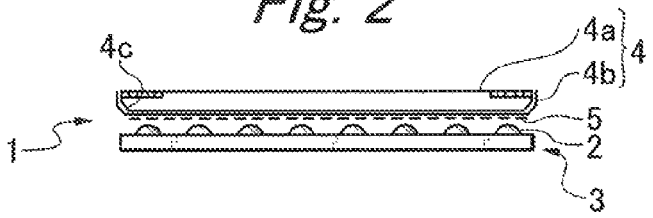
FIG. 2 is a front view of the same seismic isolation apparatus.
Figure 3:
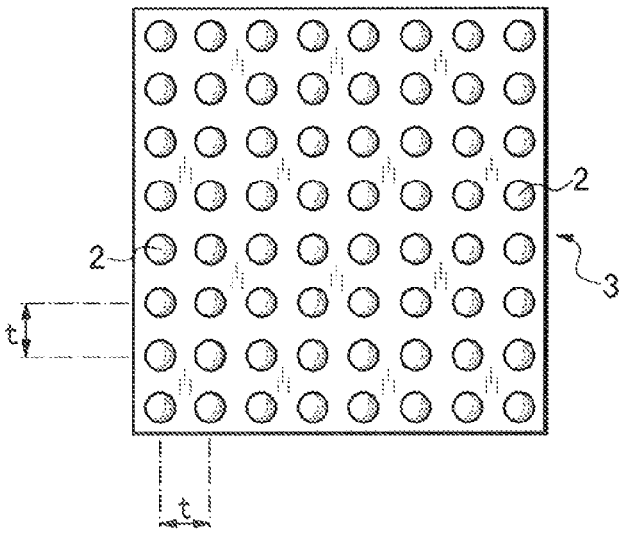
FIG. 3 is a plan view showing a hard base plate of the same seismic isolation apparatus.

A seismic isolation apparatus 1 according to a first embodiment of the invention, for example, is of a low friction combination structure formed by a point contact between an approximately planar hard base plate 3, which has a surface on which are disposed convexly curved projections 2 of a uniform height, and a smooth, flat plate-like glide plate 4, as shown in FIGS. 1 to 3. At least three of the convexly curved projections 2 being formed, in the embodiment shown in FIG. 3, for example, they are distributed aligned at a pitch t of 50 mm, but by disposing them aligned in a planar form at a pitch t in a range of 10 mm≤t≤100 mm, the hard base plate 3 acquires a more stable glide performance. In the embodiment, a height of the seismic isolation apparatus 1 is approximately 4 mm.

Figure 4:
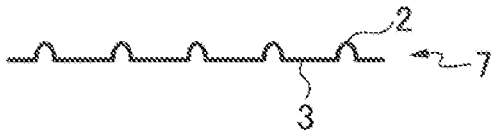
FIG. 4 is a longitudinal sectional side view of a concavely curved projection portion of the same hard base plate.

The seismic isolation apparatus 1, as shown in FIG. 2, has the approximately planar hard base plate 3, which has the convexly curved projections 2, as a lower platform, and disposes the smooth, flat plate-like glide plate 4 on top thereof. The glide plate 4 is a movable body with a taper 4*c*, formed by a cambering process, on an underside of a peripheral edge portion thereof. It is also acceptable that the convexly curved projections 2 are included in a convexly curved plate 7, in which they are formed integrated into one portion of the hard base plate 3, as shown in FIG. 4.

Figure 5A:
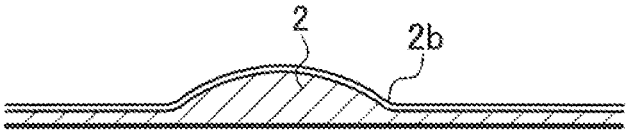
FIGS. 5A, 5B, 5C and 5D are sectional views showing, respectively, a case of providing a coating layer as an aspect of protecting the same concavely curved projections, a case of embedding a hard material, a case of modifying a surface, and a case of using a pressed steel plate.
Figure 5B:
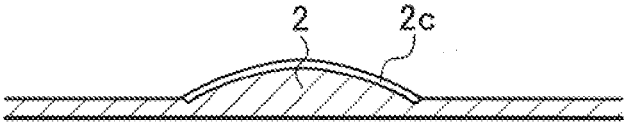
Figure 5C:
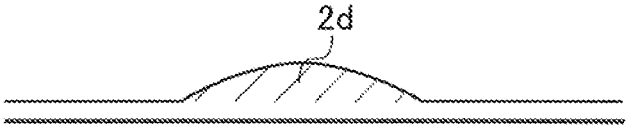
Figure 5D:
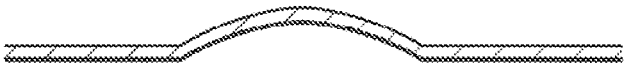

Also, as shown in FIG. 5A, in order to acquire a stable performance in a harsh environment, it is possible to apply a chemical resistant coating 2*b*, such as polyethylene, to the hard base plate 3 and the glide plate 4. Furthermore, it is also acceptable to cover the convexly curved projections 2 with a hard material 2*c*, such as a metal or a ceramic, as shown in FIG. 5B, and it is possible to obtain an even more stable glide performance by forming a surface hardening processed portion 2*d*, increasing a surface hardness of the convexly curved projections 2 and the glide plate 4, as shown in FIG. 5C. It is also possible to adopt a pressed steel plate, as shown in FIG. 5D.

Figure 6A:
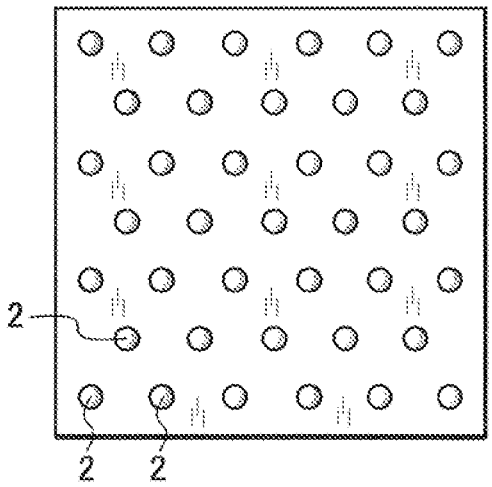
FIGS. 6A, 6B and 6C are plan views each showing a kind of disposition aspect of the concavely curved projections.
Figure 6B:
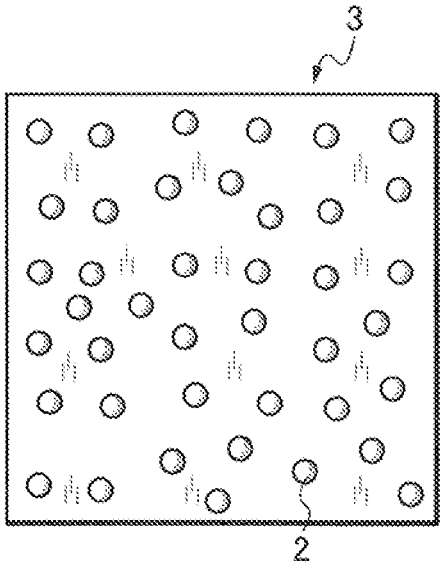
Figure 6C:
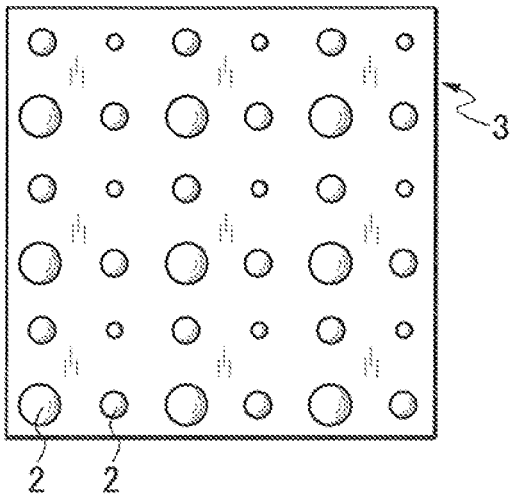
Figure 7A:
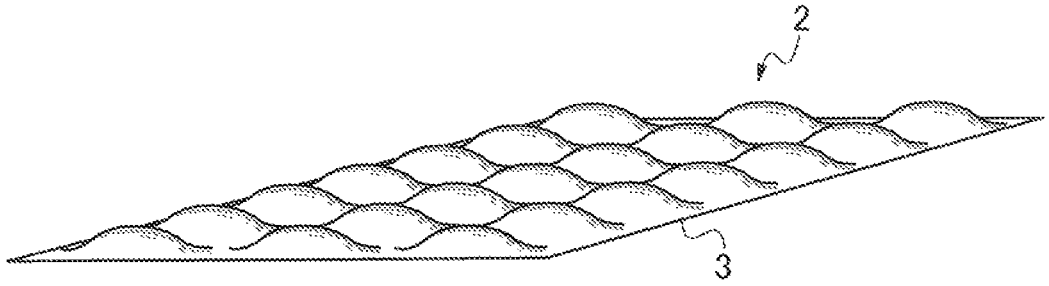
FIGS. 7A and 7B are, respectively, a perspective view and a longitudinal sectional view, each showing another embodiment of the concavely curved projections.
Figure 7B:
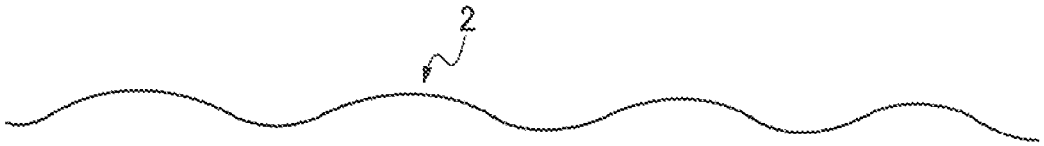

The convexly curved projections 2, as shown in FIGS. 6A to 6C, are press formed in the pressed steel plate in a staggered disposition or random disposition, or in a lattice disposition of bigger and smaller projections 2. Also, it is acceptable that the convexly curved projections 2, as shown in FIGS. 7A and 7B, are press processed into a form of continuous concave-convex surfaces, in which a radius of curvature r of a contact point is at least 30 mm.

Figure 8A:
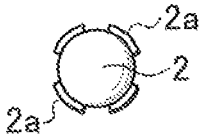
FIGS. 8A and 8B are plan views, each showing still another embodiment of the concavely curved projections.
Figure 8B:
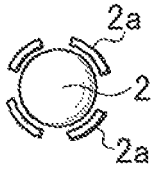

Although the steel plate is shaped by a pressing process in order to manufacture the convexly curved projections 2 at a low cost, in order to remove a warping caused by residual stress inside the steel plate due to the press shaping, intermittent slits 2*a* are formed in a circumferential direction in a peripheral portion of the convexly curved projections 2, as shown in FIGS. 8A and 8B, maintaining a planarity of the hard base plate 3. As well as the convexly curved projections 2 exhibiting an elastic effect by having the intermittent slits 2*a* along a circumferential direction of a concentric circle on an exterior thereof, a number of parts is reduced, an internal stress of the projections is released by the slits 2*a* at the time of the pressing process, and it is possible to maintain a planar accuracy of a whole of the plate.

The glide plate 4 is formed by affixing a fluoroethylene glide member 4*b* to a bottom surface of a hard plate 4*a*. A reference number 4*d* indicates an attachment for fixing the glide member 4*b*. Also, a lubricating oil or a lubricating grease, which is a viscous medium or a viscoelastic medium, being applied to a glide plate 4 side as a lubricating medium, for example, an oil 5 is applied. The oil 5 being, for example, one of a silicone oil, a grease, a heavy oil, a wax, or the like, it has a viscosity of 100 cst or more, in order that it acts as an attenuation medium too. The hard base plate 3 or the glide plate 4 uses as a material thereof a resin, a metal, a glass, a stone, mortar, concrete, a ceramic, a hard rubber, wood, or the like. For example, any one of tetrafluoroethylene, polyacetal, polyethylene, polyethylene terephthalate, polypropylene, polyvinyl chloride, nylon, ABS, polycarbonate, acryl, polyurethane, polyimide, polyester, polystyrene, melamine, or phenol is used as a resin.

Also, as a metal, a selection is made from a stainless steel plate, a steel plate, an aluminum plate, a titanium plate, a zinc plate, a copper plate, a brass plate, a nickel plate, a thallium plate, a silver plate, a gold plate, a platinum plate, an indium plate, a barium plate, a plate of an alloy thereof, a plate processed with a plating thereof, or a plate processed with a coating thereof. Also, either one of granite or marble is used as a stone.

Either one of a plate glass or a convex glass is used as a glass. Any one of granite, marble, or a grinding processed slab thereof, is used as a stone. Furthermore, of the hard base plate 3 and the glide plate 4, a contact surface of at least one has a surface layer formed of stainless steel, aluminum, steel, mortar, concrete, a ceramic, a hard rubber, tetrafluoroethylene, polyacetal, polyethylene, polypropylene, vinyl chloride, nylon, ABS, polycarbonate, acryl, polyurethane, polyimide, polyester, polystyrene, melamine, phenol, carbon powder, molybdenum disulfide powder, or a powder coating, baking coating, cation electrodeposition coating, or fluororesin coating thereof.

Figure 9:
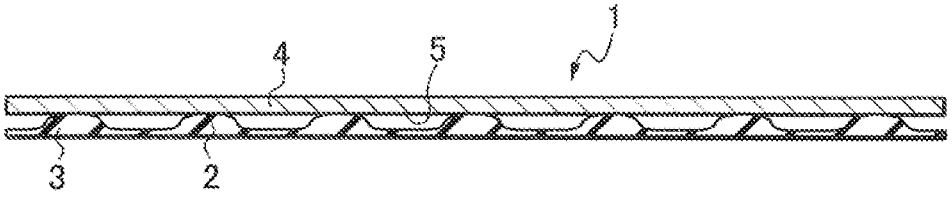
FIG. 9 is a sectional view showing a seismic isolation apparatus according to a second embodiment of the invention.

FIG. 9 showing a seismic isolation apparatus 1 according to a second embodiment, the hard base plate 3 and the glide plate 4 are made of a synthetic resin. tetrafluoroethylene, polyacetal, polyethylene, vinyl chloride, nylon, acryl, polyurethane, or the like, is used as the synthetic resin. In the case of the hard base plate 3, as the convexly curved projections 2 are also integrally molded, it is simple, and it is also possible to make the cost low.

Figure 10:
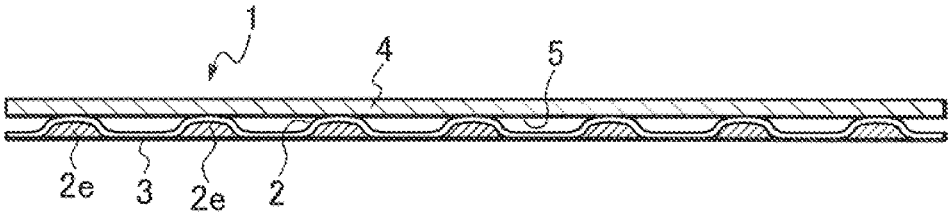
FIG. 10 is a sectional view showing a seismic isolation apparatus according to a third embodiment of the invention.

FIG. 10 shows a seismic isolation apparatus 1 according to a third embodiment, in which a hard medium 2*e* fills a concave portion on an underside of the convexly curved projections 2. By filling with the hard medium 2*e*, the convexly curved projections 2 become unlikely to collapse under a load, and a compressive strength as the seismic isolation apparatus 1 increases dramatically.

Figure 11A:
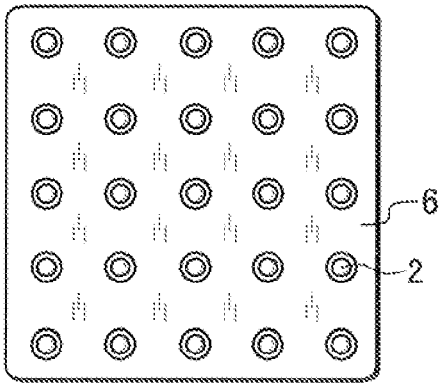
FIGS. 11A and 11B are, respectively, a plan view and a longitudinal sectional view, each showing a seismic isolation apparatus according to a fourth embodiment.
Figure 11B:
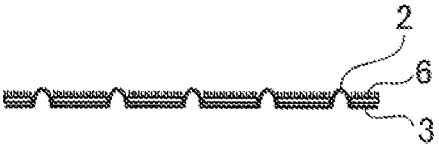

FIGS. 11A and 11B show a fourth embodiment, in which a flooring material 6 in which holes are formed is made a lower platform, the convexly curved projections 2 of the hard base plate 3 are caused to protrude upward through the holes from a rear side, and the kind of smooth glide plate 4 shown in FIG. 2 is placed on an upper side thereof as a movable body.

Figure 12A:
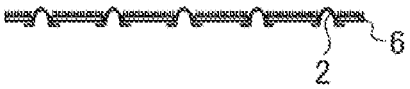
Figure 12B:
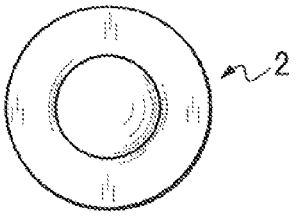
FIGS. 12B and 12C are, respectively, a plan view and a longitudinal sectional view, each showing concavely curved projections used in the same seismic isolation apparatus.
Figure 12C:
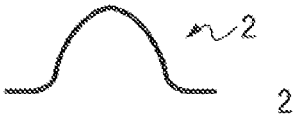

FIGS. 12A, 12B and 12C show a fifth embodiment, in which a configuration is such that the convexly curved projections 2 are made the kind of individual single bodies shown in FIGS. 12B and 12C, each convexly curved projection 2 is disposed in a position of a respective hole of the flooring material 6, and each is caused to protrude upward through the relevant hole. In the fourth embodiment and this embodiment, as the convexly curved projections 2 are facing upward, even in the event that dust or the like encroaches into a gap in the seismic isolation apparatus 1, it does not happen that it falls into an interstitial space and that a friction coefficient increases. By adopting the seismic isolation apparatus 1 with the kind of configuration of the heretofore described in the fourth embodiment and fifth embodiment, it is possible to easily adjust, making a thickness of the flooring material 6 and a height of the convexly curved projections 2 relatively higher or lower.

Figure 13A:
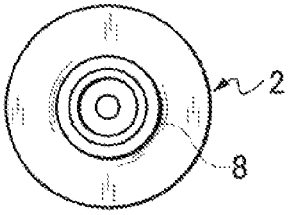
FIGS. 13A and 13B are, respectively, a plan view and a longitudinal sectional view, each showing concavely curved projections according to another embodiment.
Figure 13B:
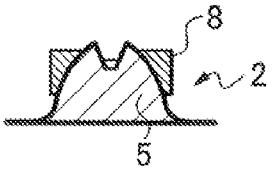

In the event of applying a lubricating medium, such as the oil 5 or a solid lubricating medium (carbon powder, molybdenum disulfide powder), to the convexly curved projections 2, it is also acceptable to adopt a configuration wherein the lubricating medium such as the oil 5 is included in the convexly curved projections 2, and a foam 8 is fitted to an exterior side of a periphery of the projections, as shown in FIGS. 13A and 13B. By so doing, by changing a material of the flooring material 6, it is possible to adjust the friction coefficient of the seismic isolation apparatus 1.

Figure 14A:
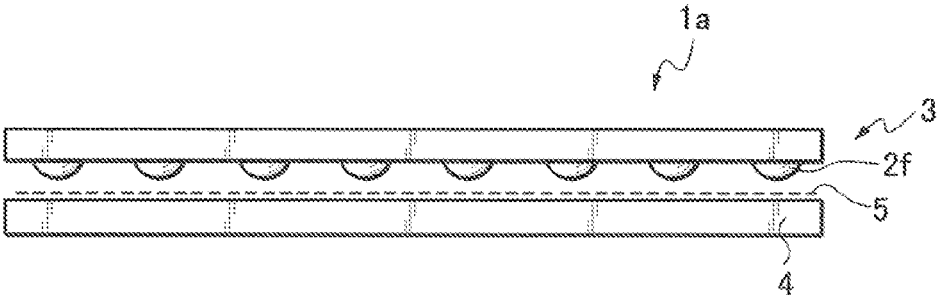
FIG. 14A is a side view showing the seismic isolation apparatus according to the fifth embodiment of the invention.
Figure 14B:
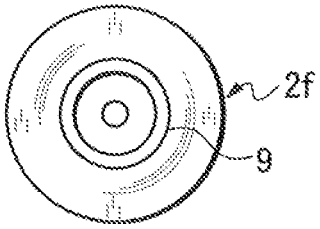
FIGS. 14B and 14C are, respectively, a plan view and a longitudinal sectional view, each showing concavely curved projections of the same seismic isolation apparatus.
Figure 14C:
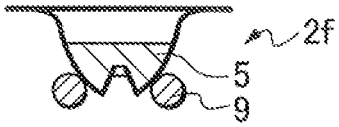

FIGS. 14A, 14B and 14C show a seismic isolation apparatus 1*a* according to a sixth embodiment of the invention, in which the smooth, approximately planar glide plate 4 is made a lower platform, and the approximately planar hard base plate 3, which has convexly curved projections 2*f*, is placed thereon, making a movable body. The convexly curved projections 2*f*, as well as the oil 5 being included inside, have an O-ring 9 fitted on a circumferential portion, as shown in FIGS. 14B and 14C. In this manner, the oil 5 is supplied naturally to the smooth plane of the glide plane 4.

Figure 15A:
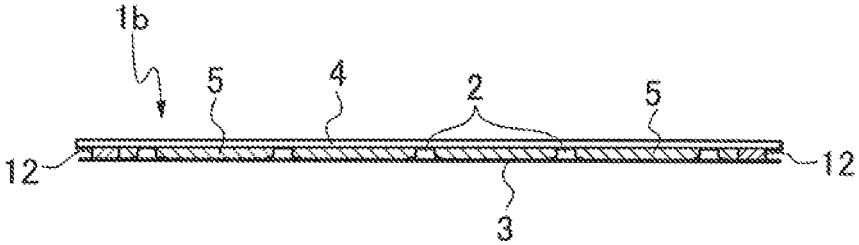
FIGS. 15A and 15B are, respectively, a longitudinal sectional view showing a seismic isolation apparatus according to a sixth embodiment of the invention, and a plan view showing a condition in which a glide plate is removed.
Figure 15B:
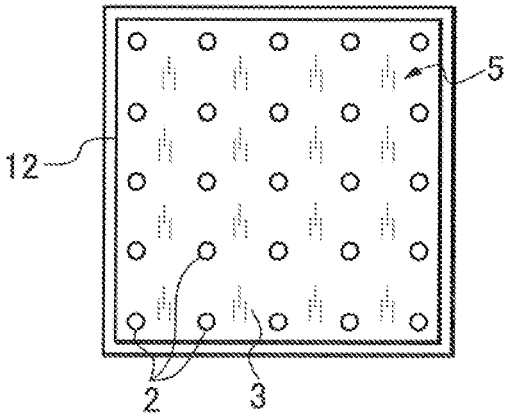

Also, FIGS. 15A and 15B show a seismic isolation apparatus 1*b* according to a seventh embodiment of the invention, in which a space appearing between the hard base plate 3 and the planar glide plate 4, due to the hard convexly curved projections 2, is filled with the oil 5, such as a grease or a wax, and a periphery is sealed with a sealing material 12. As the sealing material, for example, grease or a wax can be used. By adopting such a configuration, rainwater does not encroach into the space between the hard base plate 3 and the planar glide plate 4 inside the apparatus when used in housing, or the like, and the seismic isolation apparatus 1*b* becomes one which is highly durable.

Figure 16:
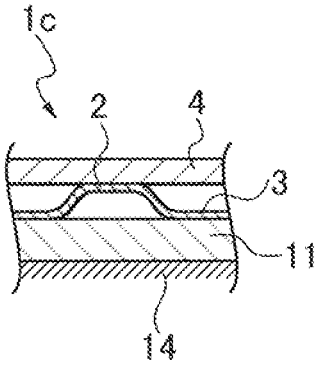
FIG. 16 is a partial longitudinal sectional view showing the seismic isolation apparatus according to the sixth embodiment of the invention.
Figure 17A:
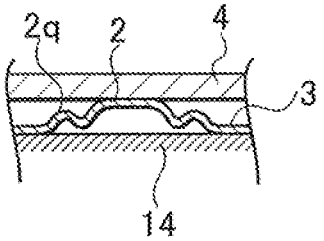
FIGS. 17A and 17B are, respectively, a partial longitudinal sectional view and a bottom view, each showing a seismic isolation apparatus according to a seventh embodiment of the invention.
Figure 17B:
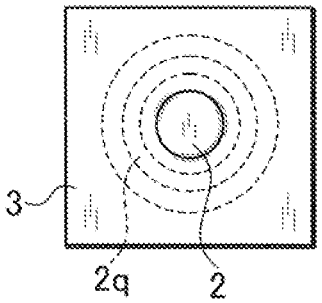

Furthermore, as an embodiment relating to another configuration of the seismic isolation apparatus of the invention, it is possible to adopt a seismic isolation apparatus 1*c* in which an elastic medium 11, such as rubber, is affixed to one of an upper surface or, as shown in FIG. 16, a lower surface of the hard base plate 3 and the planar glide plate 4 in a superimposed condition. According to such a configuration, even in the event that there is some irregularity in a floor surface 14 or in a lower surface of a seismic isolation subject, the elastic medium 11 elastically deforms, absorbing an increase or decrease of the irregularity, when sliding forward or backward, left or right, in a horizontal direction at a time of an earthquake, and the apparatus glides smoothly. Also, as shown in FIGS. 17A and 17B, approximately the same kind of function is achieved by the convexly curved projections 2 forming one more convex ring 2 on a concentric circle on the exterior thereof.

Figure 18A:
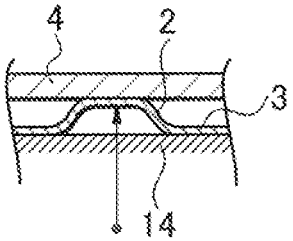
FIGS. 18A and 18B are, respectively, a partial longitudinal sectional view and a bottom view, each showing a seismic isolation apparatus according to an eighth embodiment of the invention.
Figure 18B:
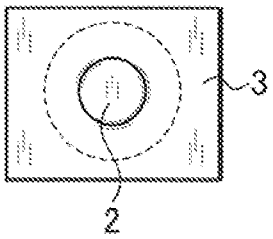
Figure 34:
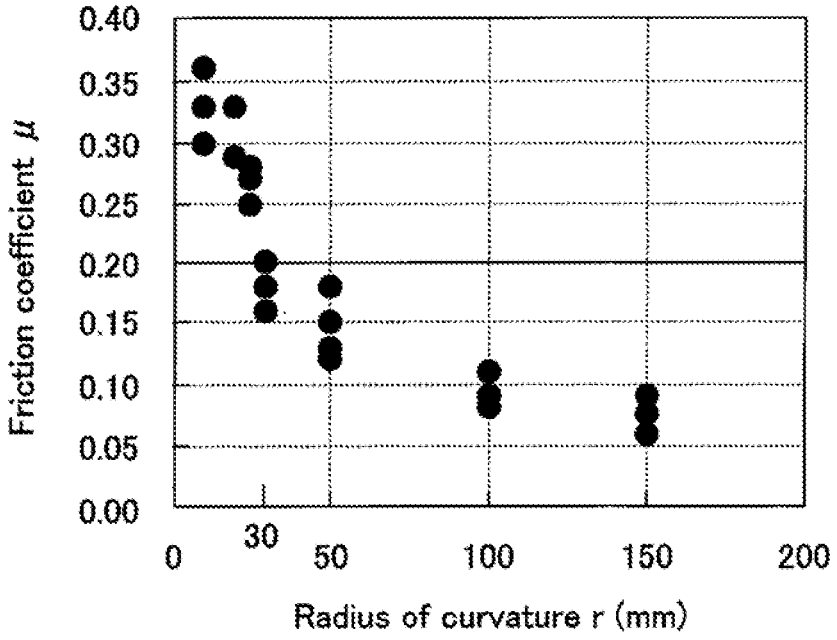
FIG. 34 is a graph of friction coefficients at different radii of curvature of convexly curved projections.

By making the heretofore described convexly curved projections 2 large projections, with the radius of curvature r being 30 mm or more at an apex thereof, as shown in FIGS. 18A and 18B, a biting of the convexly curved projections 2 into the glide plate is prevented, as a result of which, the friction coefficient becomes 0.2 or less, which is appropriate for the seismic isolation (refer to FIG. 34).

Figure 19A:
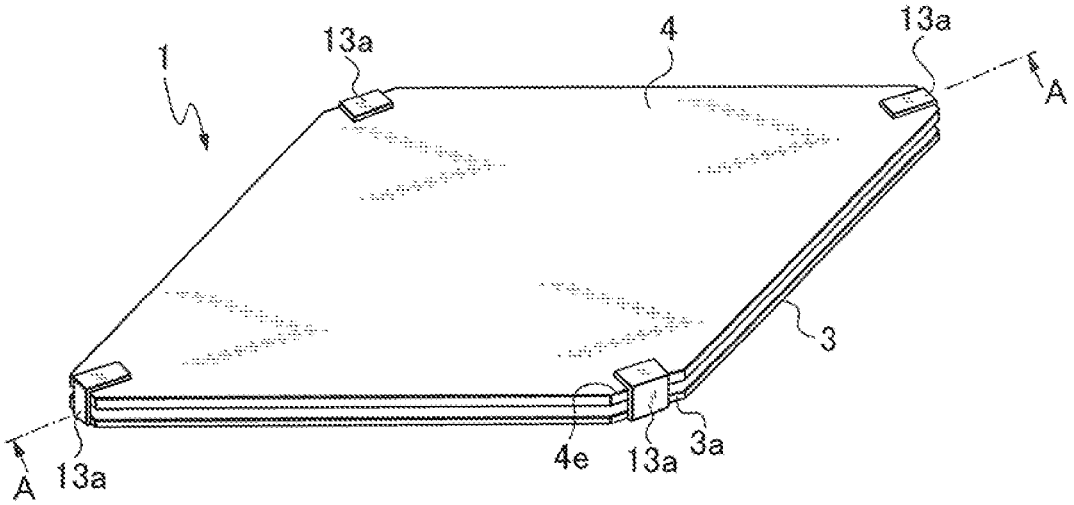
FIGS. 19A, 19B and 19C are, respectively, a perspective view, a sectional view taken along line A-A of FIG. 19A, and a partial enlarged plan view of a usage condition, showing a product aspect of the seismic isolation apparatus according to the invention.
Figure 19B:
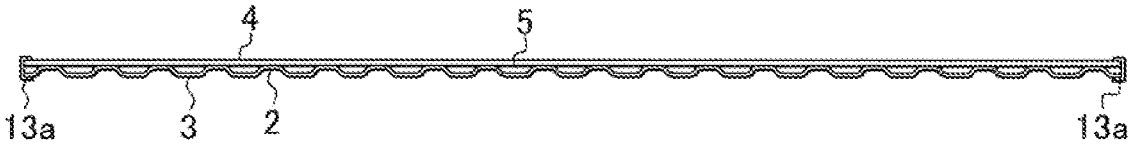

As a product aspect of the seismic isolation apparatus 1 before installing, as shown in FIG. 19A, as well as diagonally cutting corner portions 3*a* at four corners of the hard base plate 3, corner portions 4*e* of the glide plate 4 are also cut in the same way, to the same size, and the two are affixed by a tape 13*a* at the corner portions 3*a* and 4*e*. By adopting such a product aspect, the hard base plate 3 and the glide plate 4 are combined, making the seismic isolation apparatus 1 convenient for transportation.

Figure 20A:
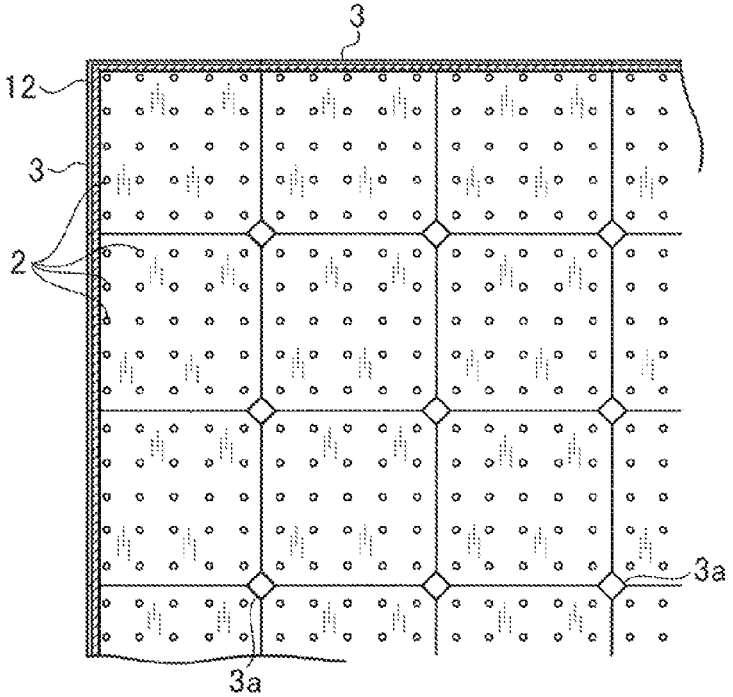
FIGS. 20A and 20B are plan views showing an aspect of the hard base plate of the seismic isolation apparatus according to the invention laid on a floor surface.
Figure 20B:
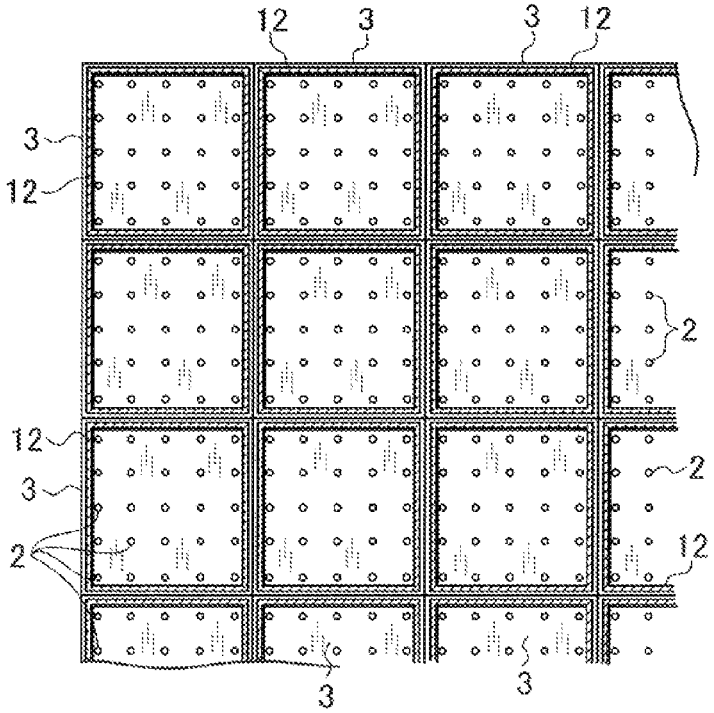

The corner portions 3*a* and 4*e* being cut, and the tape 13*a* being affixed, in this way, it is efficient in an operation of laying on a floor surface because, as the tape 13*a* is removed after disposing the seismic isolation apparatus 1 on the floor surface, it is possible to lay the hard base plate 3. At this time, double-sided tape is affixed to one portion of a rear surface of the hard base plate 3, and it is attached to the floor surface in such a way that it does not move. As a method of laying on the floor surface, there is a case of applying the sealing material 12 overall, as shown in FIG. 20A, and a case of sealing each hard base plate 3 with the sealing material 12.

Figure 19C:
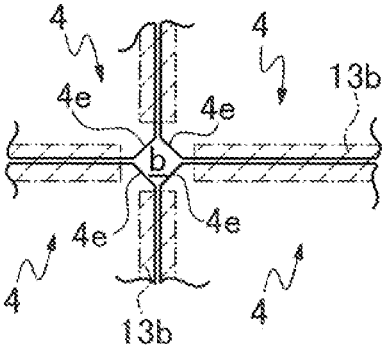

Then, when linking adjoining glide plates 4 with a tape 13*b*, or the like, the presence of the heretofore described tapes 13*a* acting as a positioning of the glide plates 4, a linking operation is easy to perform. Then, after the linking of the glide plates 4, by inserting a knife, or the like, into a space b created by bringing together the corner portions 4*e*, and severing the tapes 13*a*, as shown in FIG. 19C, the fixing to the hard base plates 3 is released, and the glide plates 4 become able to glide freely. Subsequently, the space b created by bringing together the corner portions 4*e* is covered by affixing tape over it.

Figure 21A:
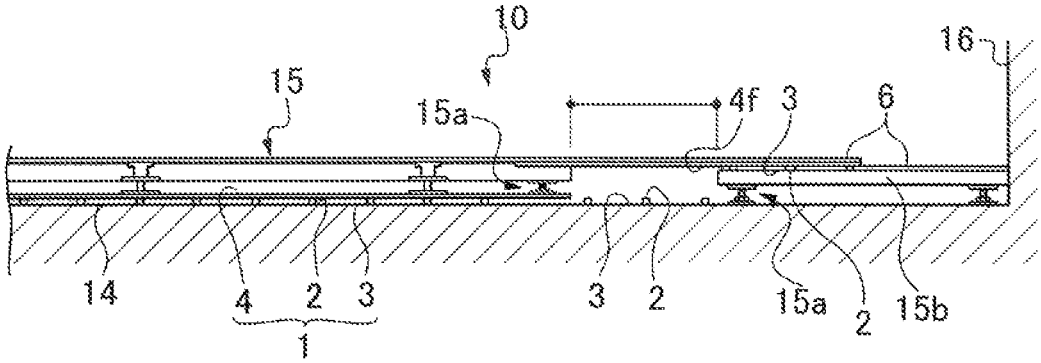
FIGS. 21A and 21B are, respectively, a longitudinal sectional view showing an aspect of the seismic isolation apparatus according to the invention laid in a room, and a longitudinal sectional view showing a condition in which an item of furniture is installed.
Figure 21B:
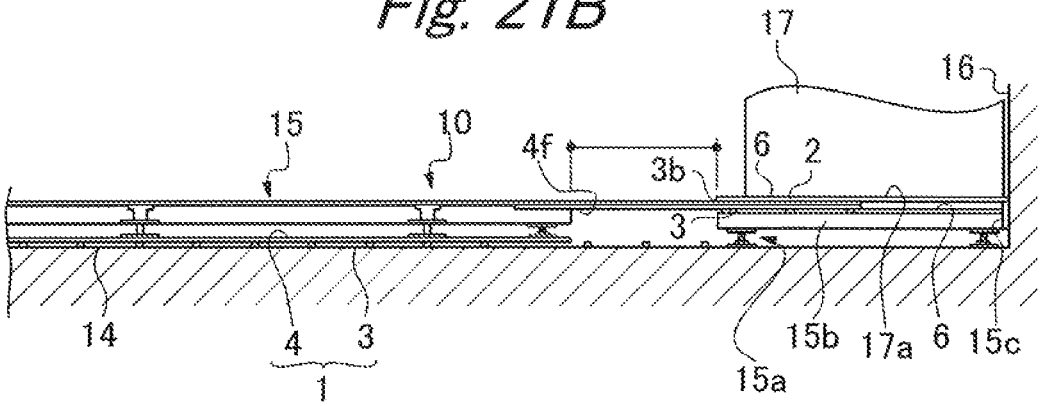

FIGS. 21A and 21B show one aspect of laying the seismic isolation apparatus 1 in a room 10 and placing furniture and the like against a wall, effectively utilizing space in the room. Using the seismic isolation apparatus 1 on the floor surface 14, with the exception of a predetermined area secured at one extremity, an OA floor 15 is formed thereon, with a support apparatus 15*a* in between. Meanwhile, a furniture base 15*b* is formed fixed in a required range from a wall surface 16, and a movement range P, over which the OA floor 15 can move at the time of an earthquake, is secured between the furniture base 15*b* and the OA floor 15. The seismic isolation apparatus 1 is disposed on the furniture base 15*b* in an area occupying approximately a half of a center of the room, which is a range in which the furniture is due to be placed. The flooring material 6 (refer to FIGS. 11A and 11B), which exposes the convexly curved projections 2 of the hard base plate 3, is laid on the furniture base 15*b* and the seismic isolation apparatus 1. A bridging glide plate 4*f* is installed from an upper surface of the flooring material 6 to a lower surface of the OA floor 15, and an extremity of the bridging glide plate 4*f* is fixed to a side edge portion of the OA floor 15. Then, a flooring material 6 is laid on the bridging glide plate 4*f*.

Figure 22:
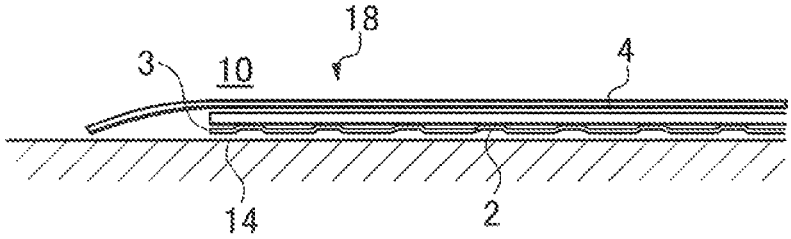
FIG. 22 is a partial sectional view showing a method of protecting an extremity in a case of laying the seismic isolation apparatus according to the invention directly on the floor surface.

When the OA floor 15 moves due to a shaking at a time of an earthquake, the bridging glide plate 4*f* and the flooring material 6 laid thereon move freely in a space up to the wall surface 16. In the event of laying the seismic isolation apparatus 1 directly on the floor surface 14, it is covered with a protective sheet 18 that is wider than the glide plate 4 of the seismic isolation apparatus 1 at an extremity, as shown in FIG. 22. As the seismic isolation apparatus 1 has a height of around 4 mm, unevenness is barely noticeable.

In order to place an item of furniture 17 on the furniture base 15*b*, as shown in FIG. 21B, a hard base plate 3*b* is duplicatively laid in a position directly above the hard base plate 3 which, being on the bridging glide plate 4*f*, is laid on the furniture base 15*b*, facing in the same vertical direction. Although it is also possible to use the hard base plate 3*b* reversed vertically, as it is preferable to arrange in such a way that dust does not collect on a glide surface when considering the encroachment of dust and the like, it is preferable to arrange in such a way that it faces in the same direction, in the way heretofore described, in order that the convexly curved projections 2 face upward.

The bridging glide plate 4*f* takes on a condition in which it is sandwiched by the hard base plates 3 and 3*b*. Then, the flooring material 6 (refer to FIGS. 11A and 11B), which exposes the convexly curved projections 2, is laid on the hard base plate 3*b*, and a bottom plate 17*a* is laid thereon, in a furniture installation range. An extremity of the bottom plate 17*a* that comes into contact with the wall surface 16 is supported by a supporting member 15*c*.

The item of furniture 17 is placed on the bottom plate 17*a*. By making a shape of the bottom plate 17*a* the same as the item of furniture 17, or slightly smaller, a resulting appearance will be attractive. The item of furniture 17 is fixed to the wall surface 16, and does not move. At a time of an earthquake, the OA floor 15 moves freely with respect to the floor surface 14, and the glide plate 4 fixed to the OA floor 15 moves freely at the same time. The hard base plate 3*b* installed on the bridging glide plate 4*f* also, being integrated, moves freely at the same time.

By so doing, the seismic isolation apparatus 1 of the invention is laid integrally on the floor surface 14, the hard base plate 3 is laid on the floor surface 14 in the movement range P, and the furniture base 15*b* is installed corresponding to a range required for a furniture placement site.

A space at least equivalent to the movement range at a time of an earthquake being secured between an exterior extremity of the bridging glide plate 4*f* and the wall surface 16, the furniture bottom plate 17*a* is laid on the duplicatively laid hard base plates 3 and 3*b*, and the floor surface 14, or the supporting member 15*c* erected from the furniture base 15*b*, is provided on a wall side extremity of the bottom plate 17*a*. Thus, at a time of an earthquake, the bridging glide plate 4*f* moves along with the floor 15 on the seismic isolation apparatus 1 laid on the floor surface 14, exercising a seismic isolation effect.

Figure 23A:
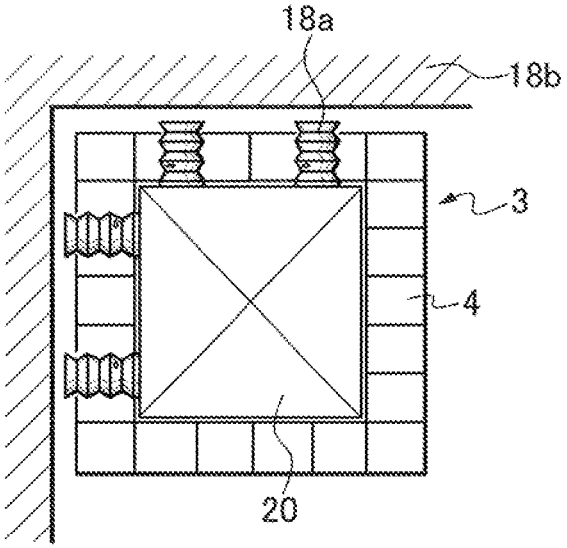
FIGS. 23A and 23B are, respectively, a plan view and a side view, each showing an aspect of using the seismic isolation apparatus according to the invention in a seismic isolation structure, such as an automatic vending machine.
Figure 23C:
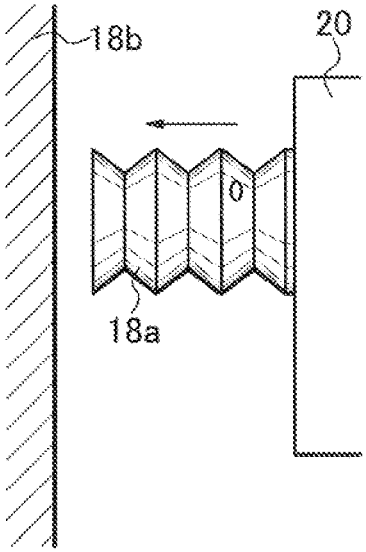
FIGS. 23C and 23D are, respectively, a side view for illustrating an effect of a damper used in the same seismic isolation structure, and a side view for illustrating an effect in a case of preventing a falling over by providing a viscoelastic medium on the damper.
Figure 23B:
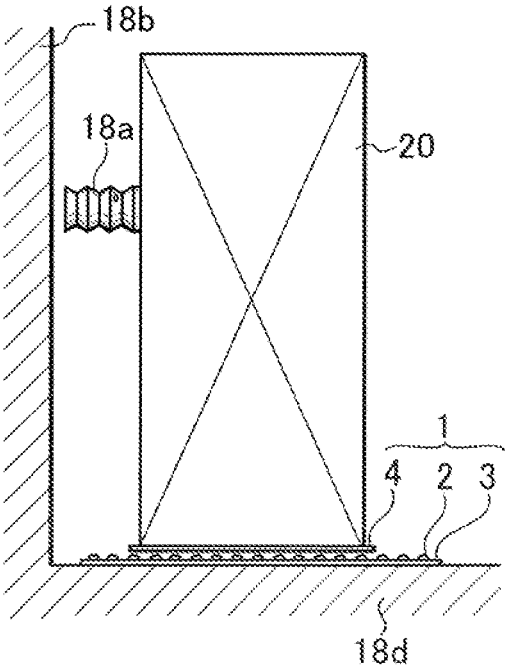

FIGS. 23A and 23B show a case of applying the seismic isolation apparatus to a cash dispenser, an automatic vending machine, an item of furniture, another instrument, or the like, as a seismic isolated structure 20 which has the seismic isolation apparatus 1 according to the invention. A damper 18*a* is provided, as a shock-absorbing material at a time of a collision, between the seismic isolated structure 20, and a wall 18*b* of a building, or the like, with which there is a danger of a side surface or a back surface of the seismic isolated structure 20 colliding at a time of an earthquake.

The seismic isolation apparatus 1 is laid on a base 18*d*, an instrument such as an automatic vending machine is installed thereon, and a material which absorbs a shock when colliding with the wall 18*b*, for example, an air pump type damper 18*a*, is provided on a back surface of a seismic isolated structure, such as the automatic vending machine. By so doing, as shown in FIG. 23C, although it can move for an instant, at a time of an earthquake, because a friction coefficient is low due to the seismic isolation apparatus 1, as the damper 18*a* is attached, this does not extend to damage such as breakage.

Figure 23D:
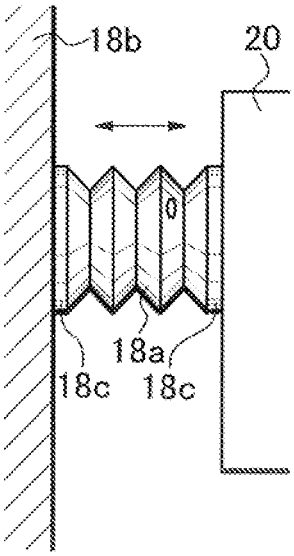

Also, as shown in FIG. 23D, by sandwiching the damper 18*a* between viscoelastic media 18*c* and 18*c*, affixing one of them to the back surface of the automatic vending machine aligned with a position of a height of an approximate center of gravity thereof, affixing the other to the wall side, and fixing them, it is possible to prevent the automatic vending machine from falling over.

Thus, by affixing the viscoelastic medium 18*c* aligned with the position of the height of the approximate center of gravity of the seismic isolated structure, the wall is protected without an excessive burden being imposed on the wall surface side, and without damage such as a peeling off occurring.

Figure 24A:
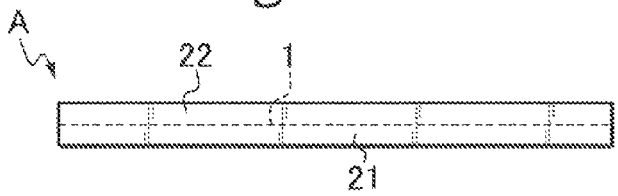
FIGS. 24A and 24B are, respectively, a side view and a plan view, each showing a structure of a foundation in a seismic isolation structure according to the invention.
Figure 24B:
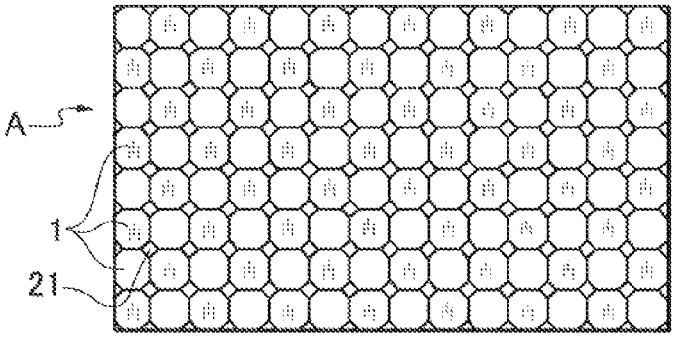
Figure 25A:
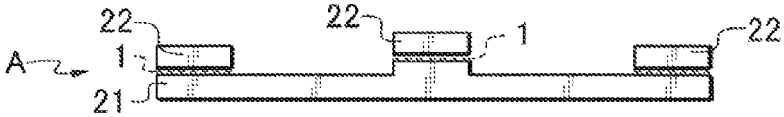
FIGS. 25A and 25B are, respectively, a side view and a plan view, each showing a structure of another aspect of a foundation in the same seismic isolation structure.
Figure 25B:
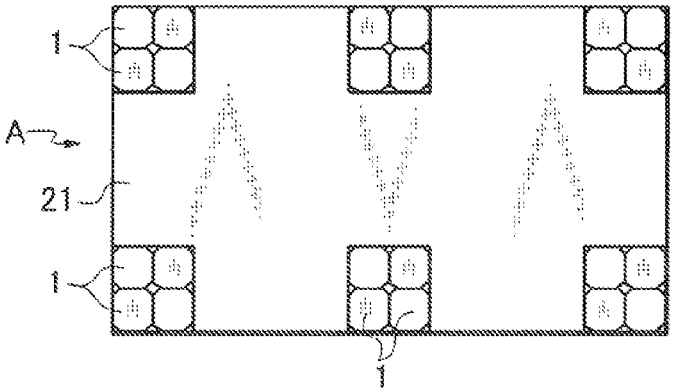
Figure 26A:
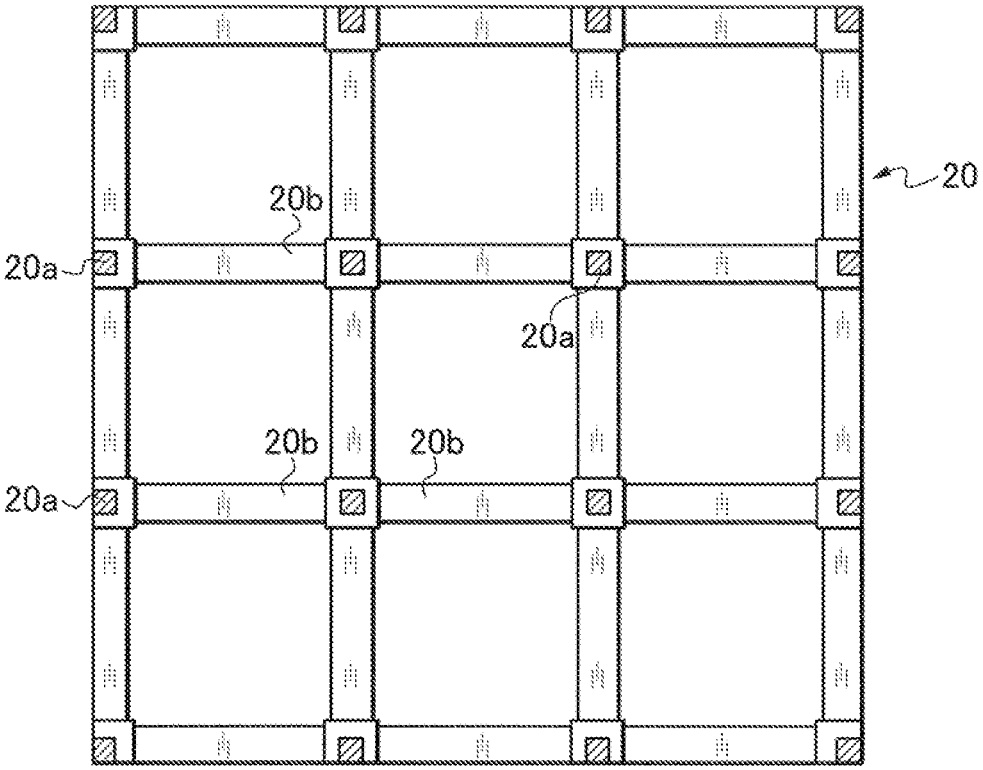
FIGS. 26A and 26B are, respectively, a transverse sectional view and a longitudinal sectional view, each showing a seismic isolation structure which is a high-rise building.
Figure 26B:
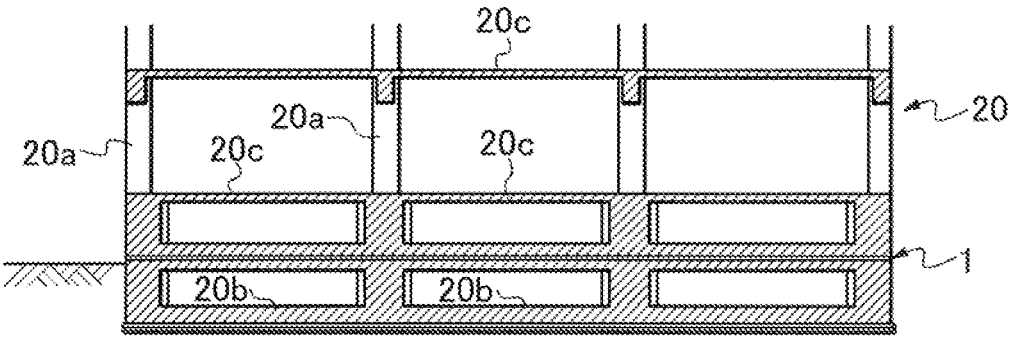

FIGS. 24A and 24B show a case in which the seismic isolated structure 20 that has the seismic isolation apparatus 1 according to the invention is a building. The seismic isolation apparatus 1 is disposed placed on one portion, or a whole, of planar surfaced lower concrete foundation 21. It is acceptable that a height of the lower concrete foundation 21 differs partially; as shown in FIGS. 25A and 25B. Also, in a case of a high-rise seismic isolated structure 20, as an axial force of pillars 20*a* is large, the seismic isolation apparatus 1 is provided distributing stress through beams 20*b* and slabs 20*c*, as shown in FIGS. 26A and 26B.

In this way, installing the seismic isolation apparatus 1 on the lower concrete foundation 21, and forming upper concrete foundation 22 of the building on the seismic isolation apparatus 1, a foundation A of the seismic isolated structure 20 is constructed.

The upper concrete foundation 22 is concrete, and glide plates 4 of adjacent seismic isolation apparatus 1 are integrated by being affixed with adhesive tape, and a joint sealed, takes the integrated glide plates 4, 4 . . . as a lower formwork, and is cast into the lower formwork and hardened.

Figure 27A:
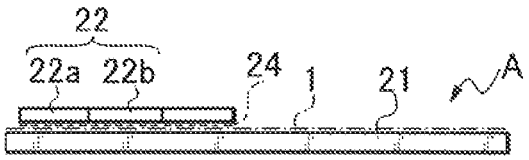
FIGS. 27A and 27B are, respectively, a side view and a plan view, each showing a foundation according to another embodiment in a seismic isolation structure.
Figure 27B:
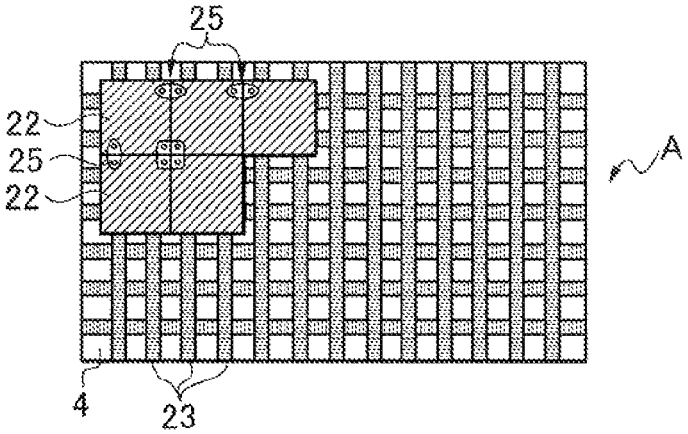

Apart from this, it is also possible to configure the upper concrete foundation 22 by making precast concrete (PC) slabs 22*a* of a size such that four corners meet at an approximate central point of the seismic isolation apparatus 1, and installing slabs integrated by joining them together with bolts 25 on the glide plates 4, 4, . . . integrated with the adhesive tape 23, with an adhesive agent 24 in between, as shown in FIGS. 27A and 27B.

Figure 28:
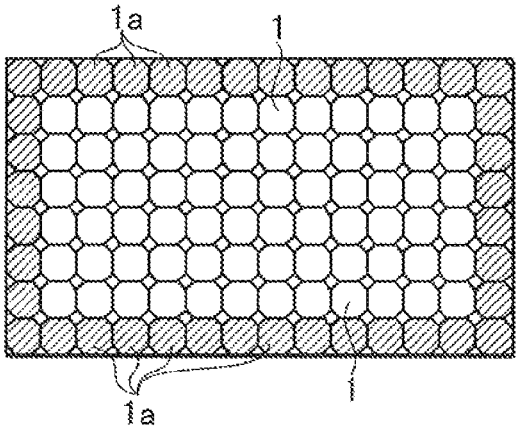
FIG. 28 is a plan view showing another distribution example of the seismic isolation apparatus in the same seismic isolation structure.

Also, as it can happen that rainwater encroaches into the foundation, in only peripheral seismic isolation apparatus 1, 1*a*, . . . among the seismic isolation apparatus 1 installed on the lower concrete foundation 21, a waterproofing agent is loaded into a space between the vertically aligned hard base plate 3 and the glide plate 4 of the seismic isolation apparatus 1*a*, integrating them, as shown in FIG. 28. As the waterproofing agent, there is, for example, a gel-type waterproofing agent or a sol-type waterproofing agent. By this means, the structure becomes waterproofed, and acts as a way of preventing corrosion of the seismic isolation apparatus 1.

Figure 29:
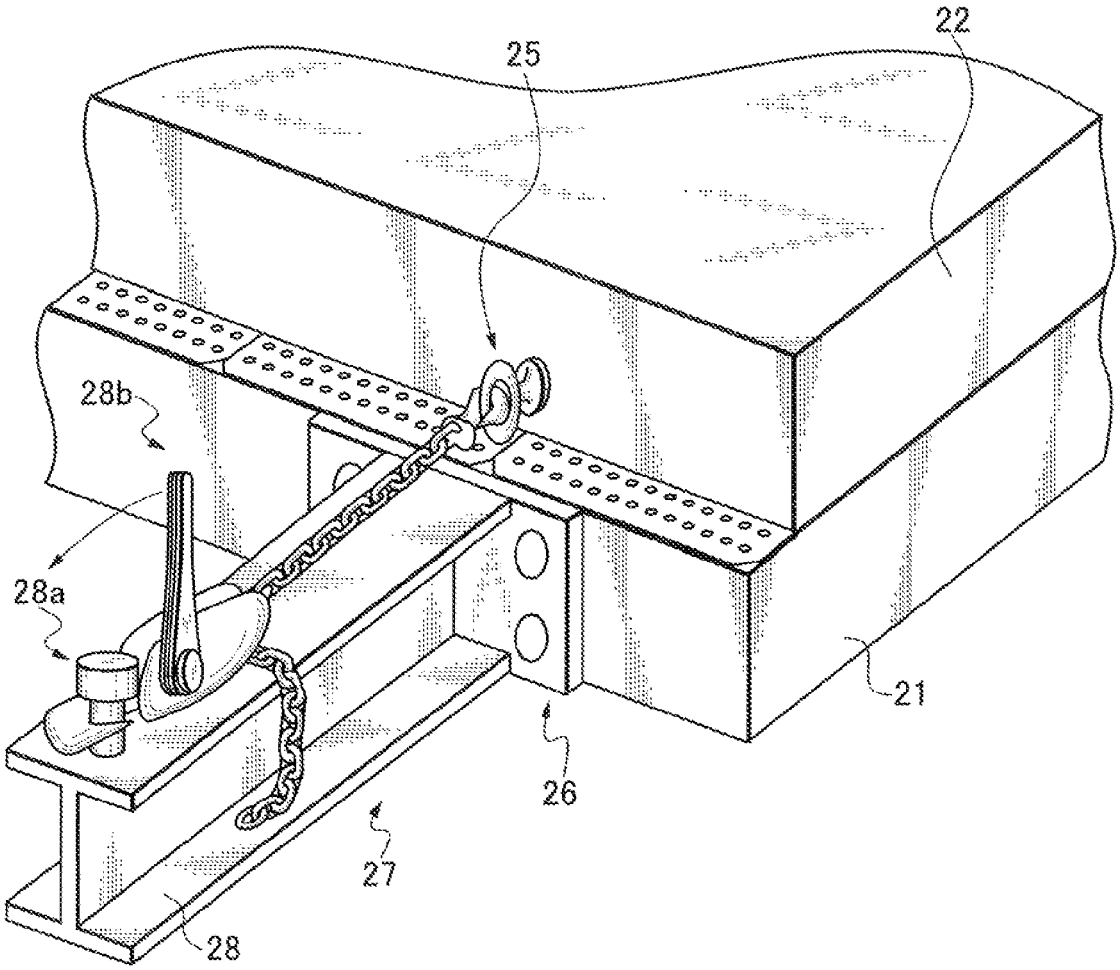
FIG. 29 is a perspective view showing an embodiment providing a movement unit, which returns the apparatus to an original position, in the foundation of the same seismic isolation structure.

Furthermore, a coupling fixing unit 26 is provided in an appropriate place on an extremity surface of the lower concrete foundation 21, as shown in FIG. 29. A movement unit 27 that moves the upper concrete foundation 22, returning it to an original position after a shaking, is provided between coupling fixing units 26, 26. The movement unit 27 is such that, for example, a steel beam 28 with a hook 28*a* attached to an extremity surface is projected, fixed to the coupling fixing unit 26, and a section between the hook 28*a* and the coupling fixing unit 26 on the extremity surface of the upper concrete foundation 22 is configured of a tension unit 28*b*, such as a lever block or a chain block. Not being limited to this, it is possible to employ an already-known movement unit. It is also acceptable that such a movement unit moves the lower concrete foundation 21.

Figure 30A:
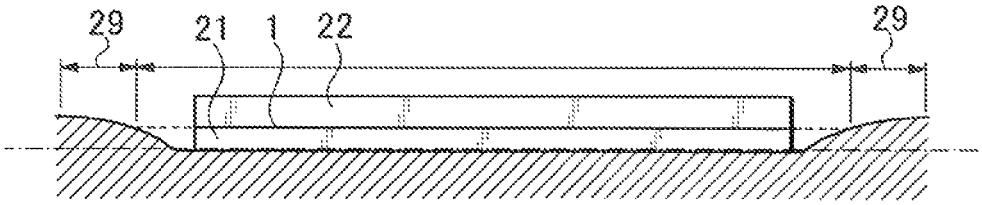
FIGS. 30A and 30B are, respectively, an enlarged sectional view showing an aspect of providing a slope, onto which the seismic isolation apparatus runs in the event of moving beyond a predetermined movement distance, in the same seismic isolation structure, and a perspective view showing an aspect of attaching a jack attachment anchor, for returning the seismic isolation apparatus after an earthquake, to a floor surface.
Figure 30B:
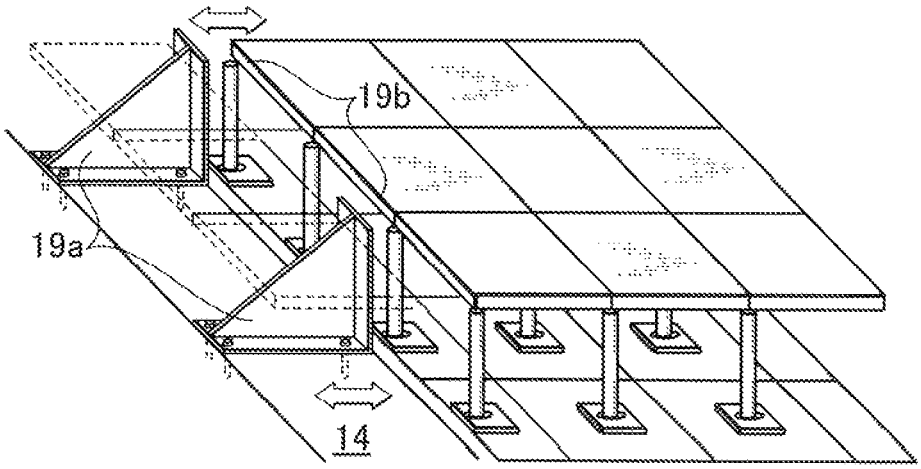

Envisaging a case in which an amount of movement due to a shaking exceeds a predetermined amount of movement, a slope 29, onto which the seismic isolation apparatus runs in the event of moving beyond a predetermined movement distance, is provided in the seismic isolation apparatus 1, as shown in FIG. 30A. By this means, as well as preventing an unforeseen movement of the seismic isolated structure 20 at a time of an earthquake, and preventing damage or the like, it is possible to assure safety. Also, as a large force is necessary to return the concrete to the original position in the event that a seismic isolation subject is extremely wide, or in the event of a heavy load, in order that it is possible to install an anchor 19*a*, as the previously described movement unit 27, on the floor surface 14 after an earthquake, it is arranged in such a way that a hydraulic jack 19*b* is attached to the anchor 19*a*, pushing back, as shown in FIG. 30B.

The slope 29, as well as acting as a movement limitation mechanism, also acts as a shock-absorbing mechanism. Consequently, it is possible to exercise the same kind of effect with an earth bank, sand, gravel, timber or the like, as well as with ground formed into a slope shape.

Also, by inserting a load sensor such as a load cell between the hook 28*a* and the tension unit 28*b*, such as the lever block or the chain block, or between the coupling fixing unit 26 and the tension unit 28*b*, or by measuring a load required for a movement using the tension unit 28*b* with a load sensor attached, it is possible to check whether the friction coefficient of the seismic isolation apparatus falls within a predetermined range. Should the friction coefficient have exceeded the predetermined range, it is possible to increase a reliability of an operation at a time of an earthquake by immediately performing maintenance.

Figure 31:
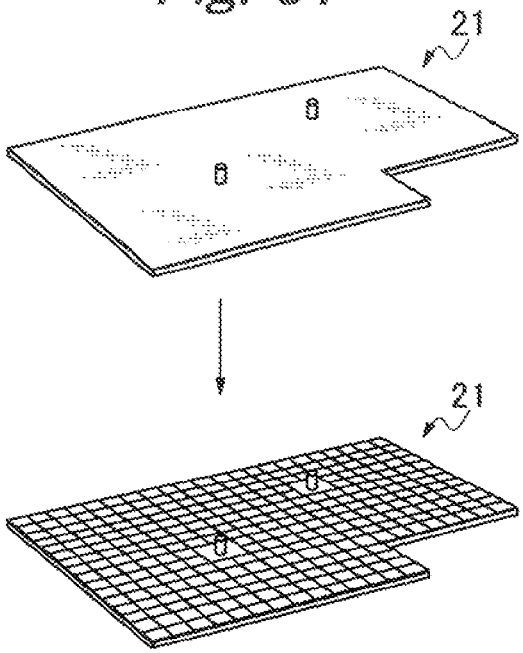
FIG. 31 is a perspective view showing a former process of a construction method in the same seismic isolation structure.

FIG. 31 shows a case of constructing the foundation of the seismic isolated structure 20 using the seismic isolation apparatus 1 according to the invention. Firstly, as shown at the top of the figure, a formwork is put together, and concrete is cast into it, forming the lower concrete foundation 21, as shown at the bottom. Furthermore, the seismic isolation apparatus 1 are installed on one portion, or the whole, of the lower concrete foundation 21.

In the installation of the seismic isolation apparatus 1 on the lower concrete foundation 21, joints are sealed by affixing the glide plates 4, 4 of the seismic isolation apparatus 1 with adhesive tape to integrate them. Ready-mixed concrete is cast with the integrated glide plates 4 as a lower formwork, as shown at the top of FIG. 32, or the precast concrete slabs 22*a* are made a size such that four corners meet at the approximate central point of the seismic isolation apparatus, and slabs integrated by joining them together with bolts are installed on the previously described integrated glide plates 4, with the adhesive agent in between.

Figure 32:
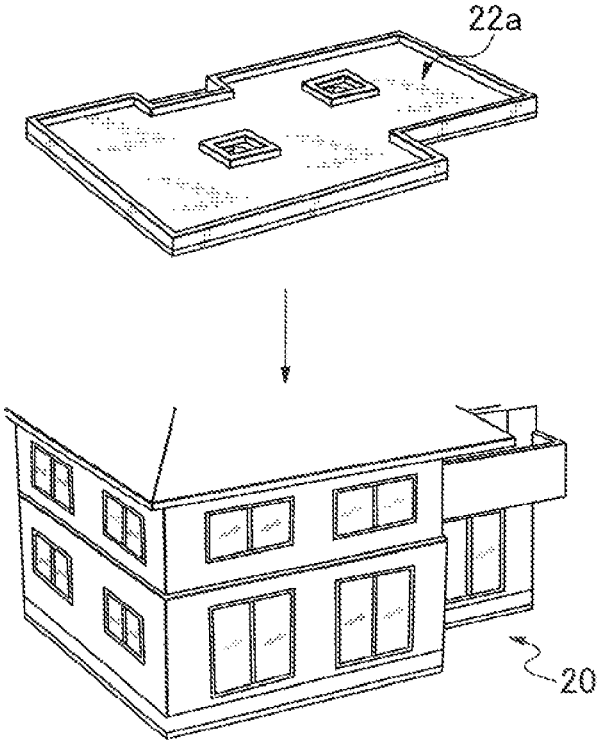
FIG. 32 is a perspective view showing a latter process of the construction method in the same seismic isolation structure.

With the cast and hardened concrete or the precast concrete slabs 22*a* as one portion of the formwork, the foundation A of the building is formed, and the seismic isolated structure 20 is constructed, as shown at the bottom of FIG. 32. By so doing, it is possible to construct the seismic isolated structure 20, such as a one-unit home, a small or medium-sized ferroconcrete structure, or a super high-rise building, with a simple operating procedure, without any troublesome work, and with a high operating efficiency.

Figure 33A:
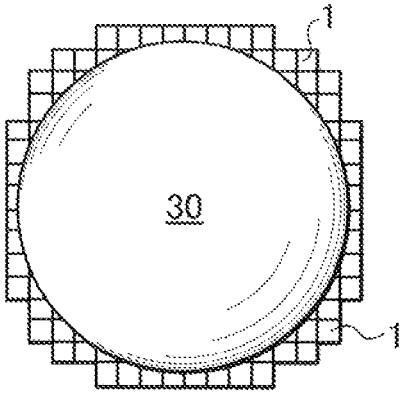
FIGS. 33A, 33B and 33C are, respectively, a plan view and a side view, each showing a case in which the seismic isolation structure of the invention is an oil tank, and a sectional view showing a case of a heretofore known example.
Figure 33B:
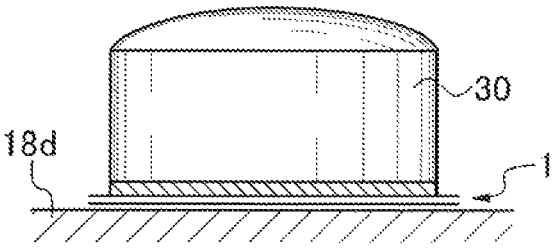
Figure 33C:
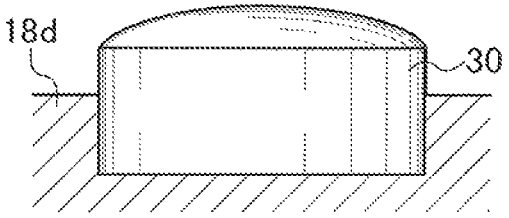
Fig. 33C PRIOR ART

FIGS. 33A and 33B show a case in which the seismic isolated structure 20 is an oil tank 30. It can be easily formed by installing the oil tank 30 on the seismic isolation apparatus 1 laid on a base. It is common for a heretofore known oil tank or natural gas tank to be of a semi-underground type, as shown in FIG. 33C, in order to avoid container damage caused by a sloshing phenomenon at a time of an earthquake. By adopting a seismic isolation oil tank or a seismic isolation natural gas tank constructed on the seismic isolation apparatus 1, it is possible to reduce huge underground excavation costs and waste soil disposal costs.

Wha is claimed is:

1. A seismic isolation apparatus comprising:

a planar hard base plate having at least three convexly curved projections which project upwardly and have a same height; and only one glide plate, the glide plate being a smooth, hard, flat plate disposed on the planar hard base plate so as to be movable relative to the planar hard base plate, wherein the projections are fixed to the planar hard base plate such that the projections do not rotate, and point contact between the projections and the glide plate provides friction, wherein each of the convexly curved projections has a radius of curvature which is 30 mm or more at an apex thereof, wherein all of the convexly curved projections of the seismic isolation apparatus project upwardly, wherein an entire bottom surface of the glide plate is a plane, and wherein movement of the glide plate relative to the planar hard base plate is initiated by seismic activity.

2. The seismic isolation apparatus of claim 1, wherein a contact surface of at least one of the hard base plate and the glide plate has a surface layer formed of any one of stainless steel, aluminum, a steel plate, tetrafluoroethylene, polyacetal, polyethylene, polypropylene, vinyl chloride, nylon, ABS, polycarbonate, acryl, polyurethane, polyimide, polyester, polyolefin, a hard rubber, carbon powder, molybdenum disulfide powder, or a powder coating, baking coating, cation electrodeposition coating, or fluororesin coating thereof.

3. The seismic isolation apparatus of claim 2, wherein the hard base plate and the glide plate are approximately rectangular flat plates, and corner portions of four corners thereof are cut diagonally so as to be chamfered.

4. A seismic isolation structure comprising:

a lower concrete foundation of a building, the lower concrete foundation having a planar upper surface;

the seismic isolation apparatus of claim 3 installed on a portion or a whole of the lower concrete foundation; and an upper concrete foundation of the building formed on the seismic isolation apparatus.

5. The seismic isolation structure of claim 4, wherein the seismic isolation apparatus is disposed in a peripheral portion of the building, and a waterproofing agent is loaded into a space between the hard base plate and the glide plate.

6. The seismic isolation structure of claim 5, wherein the seismic isolation structure is provided with a slope onto which the seismic isolation apparatus runs in the event of moving beyond a predetermined movement distance.

7. A seismic isolation structure comprising:

a seismic isolation floor formed leaving a movable range at one extremity side, using the seismic isolation apparatus of claim 2; and a non-seismic isolation floor formed in contact with a wall on the side at which the movable range is left, wherein a portion toward a center of the non-seismic isolation floor and free end portion of the seismic isolation floor are slidably piled up with providing the seismic isolation apparatus disposed therebetween.

8. A seismic isolation structure, comprising:

a lower concrete foundation of a building, the lower concrete foundation having a planar upper surface;

the seismic isolation apparatus of claim 2 installed on a portion or a whole of the lower concrete foundation; and an upper concrete foundation of the building formed on the seismic isolation apparatus.

9. The seismic isolation structure of claim 8, wherein the seismic isolation apparatus is disposed in a peripheral portion of a building, and a waterproofing agent is loaded into a space between the hard base plate and the glide plate.

10. The seismic isolation structure of claim 9, wherein the seismic isolation structure is provided with a slope onto which the seismic isolation apparatus runs in the event of moving beyond a predetermined movement distance.

11. The seismic isolation structure of claim 8, wherein the seismic isolation structure is provided with a slope onto which the seismic isolation apparatus runs in the event of moving beyond a predetermined movement distance.

12. A seismic isolation structure, comprising:

a lower concrete foundation of a building, the lower concrete foundation having a planar upper surface;

the seismic isolation apparatus of claim 2 installed on a portion or a whole of the lower concrete foundation; and an upper concrete foundation of the building formed on the seismic isolation apparatus.

13. The seismic isolation structure of claim 12, wherein the seismic isolation apparatus is disposed in a peripheral portion of a building, and a waterproofing agent is loaded into a space between the hard base plate and the glide plate.

14. The seismic isolation structure of claim 13, wherein the seismic isolation structure is provided with a slope onto which the seismic isolation apparatus runs in the event of moving beyond a predetermined movement distance.

15. The seismic isolation structure of claim 12, wherein the seismic isolation structure is provided with a slope onto which the seismic isolation apparatus runs in the event of moving beyond a predetermined movement distance.

16. The seismic isolation apparatus of claim 1, wherein the hard base plate and the glide plate are approximately rectangular flat plates, and corner portions of four corners thereof are cut diagonally so as to be chamfered.

17. A seismic isolation structure comprising:

a seismic isolation floor formed leaving a movable range at one extremity side, using the seismic isolation apparatus of claim 16; and a non-seismic isolation floor formed in contact with a wall on the side at which the movable range is left, and wherein a portion toward a center of the non-seismic isolation floor and free end portion of the seismic isolation floor are slidably piled up with providing the seismic isolation apparatus disposed therebetween.

18. A seismic isolation structure, comprising:

a lower concrete foundation of a building, the lower concrete foundation having a planar upper surface;

the seismic isolation apparatus of claim 16 installed on a portion or a whole of the lower concrete foundation; and an upper concrete foundation of the building formed on the seismic isolation apparatus.

19. The seismic isolation structure of claim 18, wherein the seismic isolation apparatus is disposed in a peripheral portion of a building, and a waterproofing agent is loaded into a space between the hard base plate and the glide plate.

20. A seismic isolation structure comprising:

a seismic isolation floor is provided, formed leaving a movable range at one extremity side, using the seismic isolation apparatus of claim 1; and a non-seismic isolation floor is formed in contact with a wall on the side at which the movable range is left, and a portion toward a center of the non-seismic isolation floor and free end portion of the seismic isolation floor are slidably piled up with providing the seismic isolation apparatus disposed therebetween.

21. A seismic isolation structure comprising:

a lower concrete foundation of a building, the lower concrete foundation having a planar upper surface;

a seismic isolation apparatus installed on the lower concrete foundation; and an upper concrete foundation of the building formed on the seismic isolation apparatus, wherein the seismic isolation apparatus comprises:

i. a planar hard base plate having at least three convexly curved projections which project upwardly and have a same height; and ii. only one glide plate, the glide plate being a smooth, hard, flat plate disposed on the planar hard base plate so as to be movable relative to the planar hard base plate, wherein the projections are fixed to the planar hard base plate such that the projections do not rotate, and point contact between the projections and the glide plate provides friction, wherein each of the convexly curved projections has a radius of curvature which is 30 mm or more at an apex thereof, wherein all of the convexly curved projections of the seismic isolation apparatus project upwardly, wherein an entire bottom surface of the glide plate is a plane, and wherein relative movement between the lower concrete foundation and the upper concrete foundation, and movement of the glide plate relative to the planar hard base plate is initiated by seismic activity.

22. A seismic isolation apparatus comprising:

a planar hard base plate having at least three convexly curved projections which project upwardly and have a same height; and only one glide plate, the glide plate being a smooth, hard, flat plate disposed on the planar hard base plate, wherein the projections are fixed to the planar hard base plate such that the projections do not rotate, and point contact between the projections and the glide plate provides friction, wherein each of the convexly curved projections has a radius of curvature which is 30 mm or more at an apex thereof, wherein all of the convexly curved projections of the seismic isolation apparatus project upwardly, wherein an entire bottom surface of the planar hard base plate is a plane, and wherein relative movement between the planar hard base plate and the glide plate is initiated by seismic activity.

* * * * *